US010458200B2

(12) United States Patent
Tse

(10) Patent No.: US 10,458,200 B2
(45) Date of Patent: Oct. 29, 2019

(54) FRAC PLUG SYSTEM HAVING BOTTOM SUB GEOMETRY FOR IMPROVED FLOW BACK, MILLING AND/OR SETTING

(71) Applicant: Schlumberger Technology Corporation, Sugar Land, TX (US)

(72) Inventor: Kyle Tse, Houston, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 218 days.

(21) Appl. No.: 15/462,015

(22) Filed: Mar. 17, 2017

(65) Prior Publication Data

US 2017/0268311 A1 Sep. 21, 2017

Related U.S. Application Data

(60) Provisional application No. 62/309,551, filed on Mar. 17, 2016.

(51) Int. Cl.
*E21B 33/129* (2006.01)
*E21B 29/00* (2006.01)
*E21B 33/12* (2006.01)

(52) U.S. Cl.
CPC ..... *E21B 33/1291* (2013.01); *E21B 29/00* (2013.01); *E21B 33/1204* (2013.01)

(58) Field of Classification Search
CPC .. E21B 33/12; E21B 33/1291; E21B 33/1204; E21B 33/122; E21B 29/00
See application file for complete search history.

(56) References Cited

U.S. PATENT DOCUMENTS

| | | | | |
|---|---|---|---|---|
| 6,796,376 | B2 * | 9/2004 | Frazier | E21B 33/1204 |
| 7,810,558 | B2 * | 10/2010 | Shkurti | E21B 33/1216 166/138 |
| 8,579,024 | B2 * | 11/2013 | Mailand | E21B 33/134 166/118 |
| 9,163,477 | B2 * | 10/2015 | Frazier | E21B 33/129 |
| 2011/0088891 | A1 * | 4/2011 | Stout | E21B 33/1204 166/120 |
| 2015/0129239 | A1 * | 5/2015 | Richard | E21B 23/06 166/377 |
| 2015/0361756 | A1 * | 12/2015 | Frazier | E21B 33/134 166/377 |
| 2016/0138363 | A1 * | 5/2016 | Sommers | E21B 23/06 166/387 |
| 2016/0290096 | A1 * | 10/2016 | Tse | E21B 33/129 |
| 2017/0260825 | A1 * | 9/2017 | Schmidt | E21B 23/01 |

* cited by examiner

*Primary Examiner* — Michael R Wills, III

(57) ABSTRACT

A technique facilitates plugging of a wellbore during, for example, a fracturing operation. A frac plug is constructed with an unobstructed internal passage and comprises a seal member combined with a plurality of slips for engaging a surrounding wall, e.g. a surrounding wellbore wall. Additionally, the frac plug comprises a lower sub having raised edges arranged to catch a ball during a flow back stage without blocking flow along the unobstructed internal passage.

20 Claims, 2 Drawing Sheets

FRAC PLUG SYSTEM HAVING BOTTOM SUB GEOMETRY FOR IMPROVED FLOW BACK, MILLING AND/OR SETTING

TECHNICAL FIELD

The present disclosure relates to frac plug systems, and more particularly, to a system and method for facilitating plugging of a wellbore.

BACKGROUND

Frac plugs are used in a wide variety of fracturing operations and often utilize similarly styled bottom subs to facilitate milling and to prevent flow back obstructions. Existing bottom subs tend to have a milling feature, such as a morse taper, a mule shoe, castellations, and/or a flow back pin to prevent obstructions from plugging an internal flow-through passage of the frac plug. However, the flow back pin blocks movement of components through the internal flow-through passage. In some applications, balls formed from degradable material have been utilized in fracturing operations, but the degradable balls tend to be expensive and complex to use for the fracturing operations.

Therefore, there is a need for an improved frac plug system and method for facilitating plugging of a wellbore.

SUMMARY

Disclosed herein is a system and method to facilitate plugging of a wellbore during, for example, a fracturing operation. The system includes a frac plug that is constructed with an unobstructed internal passage. The frac plug comprises a seal member combined with a plurality of slips for engaging a surrounding wall, e.g. a surrounding wellbore wall. The frac plug further comprises a bottom sub having raised edges arranged to catch a ball during a flow back stage without blocking flow along the unobstructed internal passage. The raised edges may be formed as teeth positioned to engage and torque lock the top of a next sequential frac plug.

This summary is provided to introduce a selection of concepts in a simplified form that are further described below in the Description of the Invention section. This Summary is not intended to identify key features or essential features of the claimed subject matter, nor is it intended to be used to limit the scope of the claimed subject matter. Furthermore, the claimed subject matter is not constrained to limitations that solve any or all disadvantages noted in any part of this disclosure.

BRIEF DESCRIPTION OF THE DRAWINGS

Certain embodiments of the disclosure will hereafter be described with reference to the accompanying drawings, wherein like reference numerals denote like elements. It should be understood; however, that the accompanying figures illustrate the various implementations described herein and are not meant to limit the scope of various technologies described herein.

DESCRIPTION OF THE INVENTION

Figure 1:
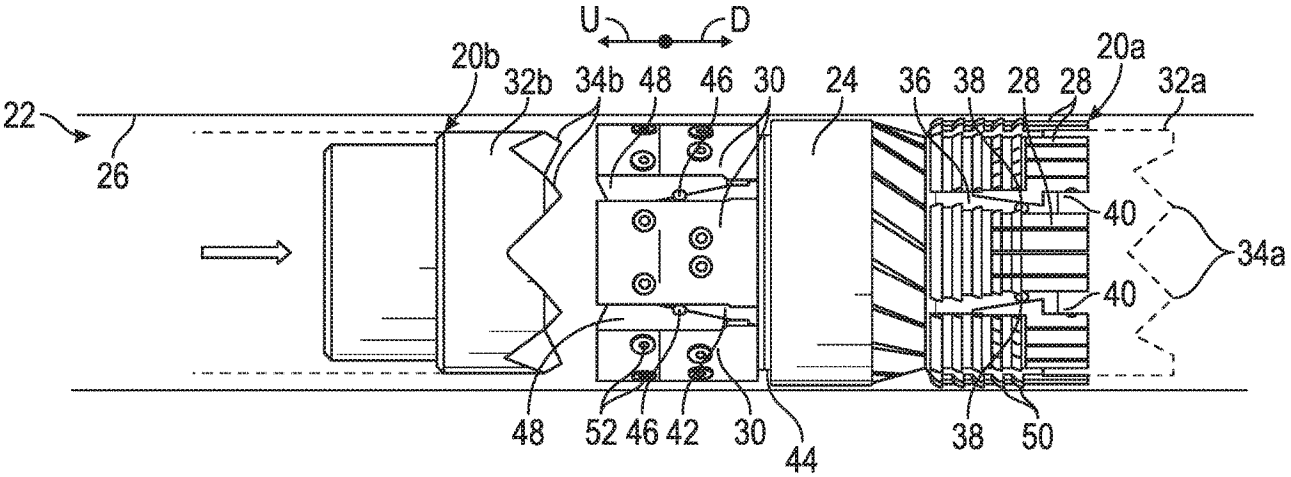
FIG. 1 is a side view of multiple frac plugs deployed in a wellbore, according to an aspect of this disclosure.

A system and methodology for plugging of a wellbore during, for example, a fracturing operation, is described. A frac plug is constructed with an unobstructed internal passage. The frac plug comprises a seal member combined with a plurality of slips for engaging a surrounding wall (e.g. a surrounding wellbore wall). For example, a plurality of upper slips and a plurality of lower slips may be used to set and secure the frac plug at a desired position along a wellbore. Additionally, the frac plug comprises a bottom sub having raised edges arranged to catch a ball during a flow back stage without blocking flow along the unobstructed internal passage. The raised edges may be formed as teeth positioned to engage and torque lock the top of a next sequential frac plug.

The frac plug may provide one or more operational improvements. For example, the frac plug may be configured to facilitate milling by providing a bottom sub which engages with a top of the next frac plug during a milling operation and provide torque lock between both frac plugs. Additionally, the frac plug may be configured to facilitate flow back operations by providing a bottom sub which prevents loose frac balls from flowing in an uphole direction and plugging the internal flow passage of a frac plug set in the wellbore at an "above" location. The construction of the frac plug provides a bottom sub which is able to catch upwardly flowing frac balls without detrimentally inhibiting flow back and without obstructing the internal flow passage with pins or other features. Consequently, some aspects of the frac plug also facilitate setting of the frac plug at desired locations along the wellbore by enabling utilization of setting tools in or through the unobstructed internal flow passage.

Certain terminology is used in the description for convenience only and is not limiting. The words "axial", "uphole", "downhole", "top", "bottom", "above," and "below" designate directions in the drawings to which reference is made. The term "substantially" is intended to mean considerable in extent or largely but not necessarily wholly that which is specified. The terminology includes the above-listed words, derivatives thereof and words of similar import.

In some aspects, the bottom sub of the frac plug may be constructed to combine at least three functions, 1.) the torque lock function, 2.) the flow block prevention function that resists the flow back of obstructions without blocking flow, and 3.) the unobstructed internal flow path function. The torque lock function may be achieved with a plurality of raised edges (e.g. teeth) configured and located to interface with the top of a subsequent frac plug. The raised edges may be constructed as a variety of repeating features. The flow block prevention function is achieved by providing the raised edges with adequate spacing so as to catch a frac ball (or other obstructions) while allowing fluid to continue flowing past the frac ball and through the internal flow passage of the frac plug. These functions also enable construction of the frac plug without conventional flow back pins, thus enabling passage of setting tools (or other tools) through an unobstructed internal flow passage of the frac plug.

Figure 2:
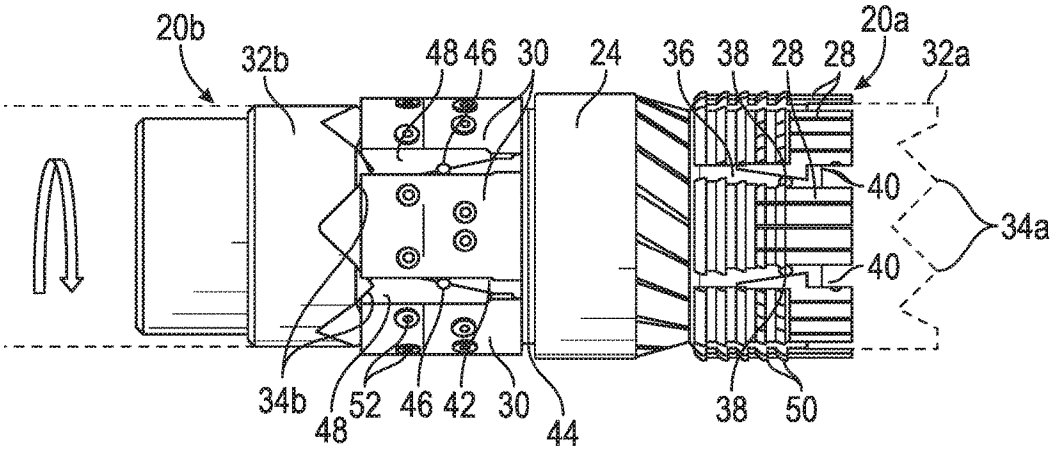
FIG. 2 is a side view of a frac plug engaged by a bottom sub of a sequential frac plug, according to an aspect of this disclosure.

FIGS. 1 and 2 illustrate a bottom frac plug 20*a* and a top frac plug 20*b* deployed in a wellbore 22, according to an aspect of this disclosure. Each frac plug 20*a* and 20*b* may include a bottom sub 32, an upper slip member 31, a mandrel 44, a seal member 24, a wedge member 36, and a lower slip member 29. It will be appreciated the each frac plug 20*a* and 20*b* may include fewer or more components.

The bottom frac plug 20*a* is set in wellbore 22 and about to be engaged by the top or subsequent frac plug 20*b* from above. The seal member 24 is selectively actuatable into sealing engagement with a surrounding wall 26 (e.g. an internal wellbore surface of a casing in wellbore 22). The lower slip member 29 and the upper slip member 31 each include a plurality of slips, such as a plurality of lower slips 28 and a plurality of upper slips 30, respectively. Both slip members 29 and 31 are actuatable to engage the surrounding wall 26 to secure the frac plugs 20*a* and 20*b* at a desired position along wellbore 22.

Each frac plug 20*a* and 20*b* comprises a respective bottom sub 32*a* and 32*b* having raised edges 34*a* and 34*b*. The raised edges 34*a* and 34*b* may be arranged to catch a frac ball, or other obstruction, during a flow back stage without blocking flow along an unobstructed internal passage 56 (See FIGS. 3 and 5). The raised edges 34*b* of the top frac plug 20*b* may be used to torque lock to the top of the sequential bottom frac plug 20*a*. In an aspect, the bottom sub 32*a* is located adjacent to the plurality of lower slips 28 of the bottom frac plug 20*a*.

The lower slips 28 may be slidably mounted on the wedge member 36 and initially held in place by a plurality of pins 38 received in slots 40 between the lower slips 28. Similarly, the upper slips 30 may be slidably mounted on a wedge section 42 of the main mandrel 44 and initially held in place by a plurality of pins 46 received in slots 48 between the upper slips 30. The lower slips 28 and the upper slips 30 may comprise a variety of engagement features, for example, lower engagement features 50 and upper engagement features 52, respectively, constructed and oriented to engage and grip the surrounding wall 26.

The bottom frac plug 20*a* may be constructed with the upper slips 30 at a top of the overall assembly forming frac plug 20*a*. When the bottom frac plug 20*a* is set at a desired location in wellbore 22, the upper slips 30 may be extended radially outward until they engage in inner surface of the surrounding wall 26. In an aspect, the upper slips 30 may be split apart until they bite into the surrounding wall 26. The raised edges 34*b* of the bottom sub 32*b* are sized and arranged to mate into the slots 48 of the bottom frac plug 20*a* between the upper slips 30. During milling, the mill pushes the bottom sub 32*b* down until it hits the top of the next sequential bottom frac plug 20*a*.

Referring to FIG. 2, the bottom sub 32*b* is engaged with the top of the bottom frac plug 20*a*. At this stage, the bottom sub 32*b* torque locks into the upper slips 30 of the next sequential bottom frac plug 20*a*. The torque lock allows for easier and faster milling. It will be appreciated, the raised edges 34*b* may also be configured to torque lock to a next sequential frac plug that may not include upper slips 30 and corresponding slots 48. For example, the next sequential frac plug may have a flat upper surface, angularly offset upper surface, projections from the upper surface, or still other configurations of an upper surface, that the raised edges 34*b* may engage and/or cut into to torque lock the frac plugs together.

Figure 3:
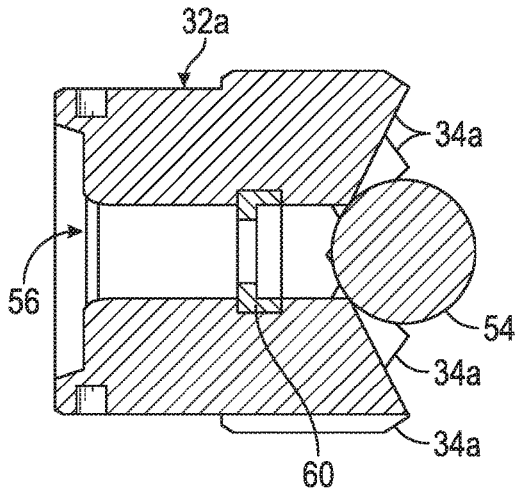
FIG. 3 is a cross-sectional view of a bottom sub engaged with a ball, according to an aspect of this disclosure.
Figure 4:
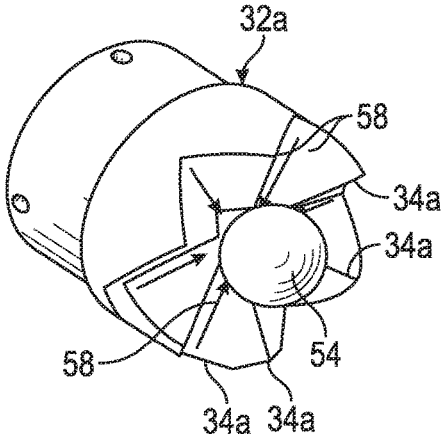
FIG. 4 is a perspective view of a bottom sub engaged with the ball, according to an aspect of this disclosure.

FIGS. 3 and 4 illustrate the bottom sub 32*a* engaged with a frac ball 54. The bottom sub 32*a* and its raised edges 34*a* are constructed so as to utilize a built-in geometry which allows fluid flow past frac balls 54 which are pushed up against the frac plug 20*a* during flow back. The raised edges 34*a* are configured to receive and support the frac ball 54 thereon, as illustrated in FIGS. 3 and 4, so that the frac ball 54 is substantially prevented from plugging the internal flow passage 56 of the frac plug 20*a*. It will be appreciated that the internal flow passage 56 extends through the entire frac plug 20*a* (See FIG. 5), and may be defined at least partially by the upper slip member 31, the main mandrel 44, wedge member 36, the lower slip member 29, and the bottom sub 32 (e.g. the upper slip member 31 may define a first portion of the internal passage 56, the bottom sub 32 may define a second portion of the internal passage 56, etc.). The internal flow passage 56 remains unobstructed because the raised edges 34*a* support the frac ball 54 below an opening to the internal flow passage 56, thereby preventing the frac ball 54 from entering the internal flow passage 56. The raised edges 34*a* can be used instead of a conventional restrictor (e.g. flow back pin), which obstructs the flow path by extending into the internal flow passage 56.

In an aspect, the raised edges 34*a* of the bottom sub 32*a* comprise six edges or teeth arranged to create six flow paths. The raised edges 34*a* may extend at least partially in an axial or downhole direction D and spaced circumferentially about the internal flow passage 56. Each of the six flow paths is represented by one of the arrows 58. The arrows 58 extend at least partially radially inwardly from an exterior of the internal flow passage 56 towards the opening to the internal flow passage 56. It will be appreciated that the raised edges 34*a* may be configured in various configurations, including fewer or more than six edges, to provide different flow rates and/or different numbers of flow paths 58. For example, the raised edges 34*a* may be constructed to provide a number of flow paths 58 that provide a flow-through area roughly equivalent to that provided by the internal flow passage 56 having a given inside diameter. In another example, the number of raised edges 34*a* may be selected to be consistent with the number of upper slips on a subsequent frac plug. In another example, the raised edges 34*a* may be configured to enable a desired flow rate into the internal flow passage 56. The size and number of these flow paths 58 may be manipulated to modify the geometry and the flow rates along flow paths 58.

The bottom sub 32*a* may comprise a shear member 60, such as a shear ring. The shear member 60 may be used with various tools to facilitate setting of the bottom frac plug 20*a*. By maintaining the internal flow passage 56 free of mechanisms (e.g. flow back pins), the inside diameter provided by internal flow passage 56 remains substantially open for receipt of tools, such as a tension mandrel 62. It will be appreciated that the internal flow passage 56 remains substantially open to enable any functionality that requires no obstructions.

Figure 5:
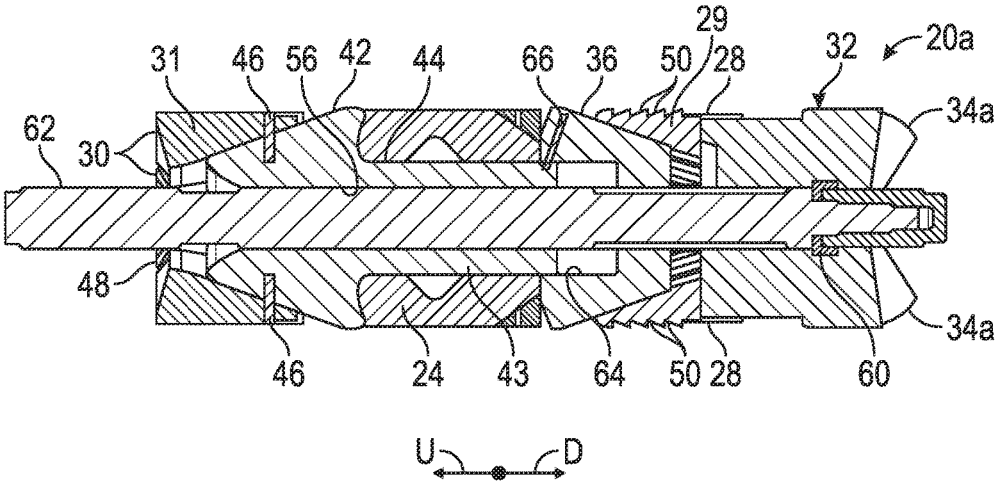
FIG. 5 is a cross-sectional view of a frac plug with an internal tension mandrel secured therein, according to an aspect of this disclosure.

As illustrated in FIG. 5, the bottom frac plug 20*a* may utilize the tension mandrel 62 to selectively set the bottom frac plug 20*a* after the frac plug 20*a* is inserted into the wellbore 22 by engaging and working in cooperation with shear member 60. For example, the internal flow passage 56 may have an inner diameter sized to receive the tension mandrel 62, and the tension mandrel 62 may be inserted through the internal flow passage 56 in the downhole direction D and engaged with and secured by the shear member 60. The shear member 60 may be positioned within a portion of the internal flow passage 56 defined by the bottom sub 32*a*. The bottom frac plug 20*a* may then be set at a desired location along wellbore 22 by applying a sufficient pull force on tension mandrel 62 in an uphole direction U. The uphole direction U opposes the downhole direction D. The tension mandrel 62 may have an outer diameter that is substantially equal to the inner diameter of the internal flow passage 56. In an aspect, the outer diameter of the tension mandrel 62 may be substantially equal to an inner diameter of the bottom sub 32*a*.

The pull force on tension mandrel 62 in the uphole direction U causes lower slips 28 and upper slips 30 to slide along the angled surfaces of wedge member 36 and wedge section 42, respectively. The pull force simultaneously moves main mandrel 44 farther into an internal recess 64 defined by the wedge member 36. The internal recess 64 is sized and oriented to slidably receive a portion of main mandrel 44 so as to enable linear squeezing of seal member 24. The seal member 24 may be positioned on an outer surface of a cylindrical section 43 of the main mandrel 44. The linear squeezing forces the seal member 24 to expand radially outward into engagement with the surrounding wall 26. In some aspects, a wedge shear member 66 (e.g. a shear pin) may be used to secure wedge member 36 to main mandrel 44 prior to setting the frac plug 20.

The absence of a flow back pin, or other flow back mechanisms, allows the setting force to be applied at a lower portion, e.g. bottom sub 32, of the frac plug 20. The unobstructed flow passage 56 also allows various other types of tools to pass into and/or through the frac plug 20. Once the frac plug 20 is set at the desired location along wellbore 22, the shear member 60 may be sheared and the tension mandrel 62 may be removed from the frac plug 20. By way of example, the shear member 60 may be sheared by applying additional pulling force (i.e. a shear force) to tension mandrel 62 in the uphole direction U. The shear force may be greater than the force applied to set the frac plug 20.

Although reference was made to the raised edges 34*a* of the bottom sub 32*a* in the above described example for different configurations of the bottom frac plug 20*a*, similar configurations may also be employed on the top frac plug 20*b* or other frac plugs positioned within the wellbore 22.

These specific embodiments described above are for illustrative purposes and are not intended to limit the scope of the disclosure as otherwise described and claimed herein. Modification and variations from the described embodiments exist. The scope of the invention is defined by the appended claims.

What is claimed is:

1. A frac plug for plugging a wellbore, the frac plug having an internal passage extending therethrough, the frac plug comprising:

a bottom sub positioned at a bottom end of the frac plug, the bottom sub defining a portion of the internal passage, the bottom sub having a plurality of raised edges extending in an axial direction and spaced circumferentially about the internal passage, wherein each of the plurality of raised edges is configured to rotationally lock the frac plug to a subsequent frac plug positioned below the frac plug in the wellbore, wherein the raised edges are configured to receive a frac ball without substantially preventing fluid flow through the internal passage.

2. The frac plug of claim 1, wherein an inner diameter of the internal passage is sized to receive a tool therethrough, the tool having an outer diameter that is substantially equal to an inner diameter of the portion of the internal passage defined by the bottom sub.

3. The frac plug of claim 2, further comprising:

an internal shear member positioned within the second portion of the internal passage, the internal shear member configured to secure the tool within the internal passage.

4. The frac plug of claim 1, wherein the raised edges are configured to enable a desired flow rate when the frac ball is received thereon.

5. A frac plug for plugging a wellbore, the frac plug having an internal passage extending therethrough, the frac plug comprising:

a bottom sub positioned at a bottom end of the frac plug, the bottom sub defining a portion of the internal passage, the bottom sub having a plurality of raised edges extending in an axial direction and spaced circumferentially about the internal passage, wherein each of the plurality of raised edges is configured to rotationally lock the frac plug to a subsequent frac plug positioned below the frac plug in the wellbore, and a slip member positioned at a top end of the frac plug, the slip member defining a second portion of the internal passage, the slip member having a plurality of slips spaced circumferentially about the internal passage.

6. The frac plug of claim 5, further comprising:

a seal member selectively actuatable into sealing engagement with an inner surface of the wellbore.

7. The frac plug of claim 6, wherein the slip member is an upper slip member, the upper slip member being actuatable into sealing engagement with the inner surface of the wellbore, the frac plug further comprising:

a lower slip member being actuatable into sealing engagement with the inner surface of the wellbore.

8. The frac plug of claim 7, further comprising:

a main mandrel having a mandrel wedge section and a cylindrical section, wherein the upper slip member is slidably mounted on the mandrel wedge section, and wherein the seal member is positioned on an outer surface of the cylindrical section.

9. The frac plug of claim 8, further comprising:

a wedge member defining an internal recess, wherein the main mandrel is slidably received within the internal recess, wherein the seal member is selectively actuatable by sliding the main mandrel within the internal recess.

10. A method for milling a frac plug within a wellbore comprising:

inserting the frac plug into the wellbore, the frac plug having an unobstructed internal passage extending therethrough, the frac plug including a bottom sub defining a portion of the internal passage, the bottom sub having a plurality of raised edges extending in an axial direction and spaced circumferentially about the internal passage, wherein the raised edges are configured to receive a frac ball without substantially preventing fluid flow through the internal passage; and engaging a subsequent frac plug positioned below the inserted frac plug with the raised edges of the bottom sub, wherein the raised edges rotationally lock the inserted frac plug to the subsequent frac plug.

11. The method of claim 10, wherein the frac plug includes an upper slip member, wherein the bottom sub has a shear member positioned within, the method further comprising:

inserting a tool through the internal passage of the frac plug in a downhole direction to engage the shear member; and applying a force by the tool on the frac plug via the shear member in an uphole direction causing the upper slip member to extend in a radial direction and engage an inner surface of the wellbore.

12. The method of claim 11, wherein the frac plug further includes a lower slip member and a main mandrel, wherein lower slip member and the main mandrel define a portion of the internal passage.

13. The method of claim 12, wherein the force applied by the tool causes the lower slip member and the seal member to extend in the radial direction and engage the inner surface of the wellbore.

14. The method of claim 13, wherein the force is a setting force, the method further comprising:

applying a shear force by the tool on the shear member to shear the shear member, the shear force being greater than the setting force.

15. A frac plug having an unobstructed internal passage extending therethrough, the frac plug comprising:

a main mandrel having a mandrel wedge section and a cylindrical section, wherein the upper slip member is slidably mounted on the mandrel wedge section;

a seal member positioned on an outer surface of the cylindrical section of the main mandrel;

a wedge member defining an internal recess, wherein the main mandrel is slidably received within the internal recess, wherein the seal member is selectively actuatable by sliding the main mandrel within the internal recess;

a lower slip member having a plurality of engagement features spaced circumferentially about an outer surface of the lower slip member, wherein the lower slip member is slidably mounted on the wedge member; and a bottom sub coupled to the lower slip member, the bottom sub having a plurality of raised edges extending in an axial direction and spaced circumferentially about a lower end of the bottom sub.

16. The frac plug of claim 15, further comprising: an upper slip member having a plurality of slips spaced circumferentially about the internal passage; and a wedge member defining an internal recess, wherein the main mandrel is slidably received within the internal recess, wherein the seal member is selectively actuatable by sliding the main mandrel within the internal recess.

17. The frac plug of claim 15, wherein each of the plurality of raised edges is configured to rotationally lock the frac plug to a subsequent frac plug positioned below the frac plug in the wellbore.

18. The frac plug of claim 17, wherein the plurality of raised edges are positioned between each of a plurality of slips on the subsequent frac plug.

19. The frac plug of claim 15, wherein an inner diameter of the internal passage is sized to receive a tool therethrough, the tool having an outer diameter that is substantially similar to an inner diameter of the internal passage.

20. The frac plug of claim 15, wherein the seal member selectively actuatable into sealing engagement with an inner surface of the wellbore, wherein the seal member is selectively actuatable by sliding the main mandrel within the internal recess.

* * * * *